US010406583B2

(12) United States Patent
Jensen et al.

(10) Patent No.: US 10,406,583 B2
(45) Date of Patent: Sep. 10, 2019

(54) APPARATUS, SYSTEM, AND METHOD FOR FORMING METAL PARTS

(71) Applicant: The Boeing Company, Chicago, IL (US)

(72) Inventors: David G. Jensen, Auburn, WA (US); Michael D. McGraw, Bonney Lake, WA (US)

(73) Assignee: The Boeing Company, Chicago, IL (US)

( * ) Notice: Subject to any disclaimer, the term of this patent is extended or adjusted under 35 U.S.C. 154(b) by 575 days.

(21) Appl. No.: 14/965,703

(22) Filed: Dec. 10, 2015

(65) Prior Publication Data

US 2017/0165736 A1 Jun. 15, 2017

(51) Int. Cl.

| | |
|---|---|
| ***B21D 31/06*** | (2006.01) |
| ***C21D 7/04*** | (2006.01) |
| ***B21D 37/18*** | (2006.01) |
| ***B21D 31/00*** | (2006.01) |

(52) U.S. Cl.

CPC ..... *B21D 31/06* (2013.01); *B21D 31/005* (2013.01); *B21D 37/18* (2013.01); *C21D 7/04* (2013.01)

(58) Field of Classification Search

CPC ..... B21D 31/06; B21D 31/005; B21D 31/18; C21D 7/04; C21D 7/08; C21D 7/06; B23P 9/04; B24B 39/026

See application file for complete search history.

(56) References Cited

U.S. PATENT DOCUMENTS

| | | | | |
|---|---|---|---|---|
| 2,483,626 | A | | 10/1949 | Daku |
| 3,705,511 | A | | 12/1972 | Brandel et al. |
| 4,349,074 | A | | 9/1982 | Ince |
| 4,416,130 | A | | 11/1983 | Judge, Jr. |
| 4,694,672 | A | | 9/1987 | Baughman |
| 4,937,421 | A | | 6/1990 | Ortiz et al. |
| 5,119,667 | A | | 6/1992 | Hollis et al. |
| 5,305,361 | A | * | 4/1994 | Enomoto ..... B05B 15/061 134/1 |
| 5,742,028 | A | | 4/1998 | Mannava et al. |
| 5,771,729 | A | | 6/1998 | Bailey et al. |
| 5,778,713 | A | * | 7/1998 | Butler ..... B24C 1/003 451/39 |
| 6,014,885 | A | | 1/2000 | Griffaton |

(Continued)

FOREIGN PATENT DOCUMENTS

| | | |
|---|---|---|
| EP | 1528110 | 5/2005 |
| WO | WO 2012173140 | * 12/2012 |

OTHER PUBLICATIONS

Notice of Allowance for U.S. Appl. No. 14/031,771 dated Aug. 9, 2016.

(Continued)

*Primary Examiner* — Debra M Sullivan

(74) *Attorney, Agent, or Firm* — Kunzler Bean & Adamson

(57) ABSTRACT

An apparatus for forming a metal workpiece having a first surface is described herein. The apparatus includes a trough containing a liquid. The apparatus also includes a support for positioning the metal workpiece in an impact-receiving position. In the impact-receiving position, the first surface is submerged in the liquid. The apparatus includes a driven member for applying multiple impacts to the first surface of the metal workpiece while the metal workpiece is in the impact-receiving position.

20 Claims, 5 Drawing Sheets

FIG. 1

(56) References Cited

U.S. PATENT DOCUMENTS

| | | | | |
|---|---|---|---|---|
| 6,410,884 | B1 | 6/2002 | Hackel et al. | |
| 6,422,082 | B1 * | 7/2002 | Suh | B23K 26/0069 73/11.02 |
| 6,519,991 | B2 | 2/2003 | Hirano et al. | |
| 6,664,506 | B2 | 12/2003 | Clauer et al. | |
| 6,670,578 | B2 | 12/2003 | Hackel et al. | |
| 6,698,286 | B1 | 3/2004 | Woods et al. | |
| 6,742,377 | B2 | 6/2004 | Woods et al. | |
| 6,862,913 | B2 | 3/2005 | Lempenauer et al. | |
| 6,932,876 | B1 | 8/2005 | Statnikov | |
| 7,431,779 | B2 | 10/2008 | Statnikov | |
| 8,316,524 | B1 | 2/2012 | LeMieux | |
| 8,302,450 | B2 | 11/2012 | Slattery et al. | |
| 8,323,427 | B1 | 12/2012 | Slattery et al. | |
| 8,645,086 | B1 | 2/2014 | Castle et al. | |
| 8,739,589 | B2 | 6/2014 | Hennig | |
| 8,997,545 | B1 | 4/2015 | Lundquist et al. | |
| 9,200,341 | B1 * | 12/2015 | Sanders | C21D 7/06 |
| 2002/0096504 | A1 | 7/2002 | Hackel et al. | |
| 2003/0052103 | A1 * | 3/2003 | Friedman | B23K 26/0604 219/121.78 |
| 2007/0234772 | A1 | 10/2007 | Prevey | |
| 2008/0308199 | A1 | 12/2008 | Locker | |
| 2009/0056399 | A1 * | 3/2009 | Hatou | C21D 1/06 72/53 |
| 2010/0257910 | A1 | 10/2010 | Castle et al. | |
| 2011/0005288 | A1 * | 1/2011 | Matsui | C21D 7/06 72/56 |
| 2013/0233040 | A1 * | 9/2013 | Butler | C21D 1/09 72/56 |
| 2014/0007394 | A1 | 1/2014 | Haas et al. | |
| 2014/0366600 | A1 * | 12/2014 | Kozaki | B30B 1/186 72/20.3 |
| 2015/0075240 | A1 | 3/2015 | Lundquist et al. | |
| 2015/0075248 | A1 | 6/2015 | Lundquist et al. | |

OTHER PUBLICATIONS

Ultrasonic Needle Straightening or Forming, http://www.sonats-et.com/page_21-needle-straightening.html, accessed Dec. 12, 2015.

DeBoer, Clint "How's It Work? Rotary Hammers", published on ProTool Reviews vol. 1 Issue May 3, 2013.

DeWalt Product Service website Model D25831 http://servicenet.dewalt.com/Products/Detail?productNumber=D25831K.

Didier, Will, "Development and Validation of a Mathematical Model for Predicting the Performance of Rotary Hammer Drills" (2013). University of Wisconsin Milwaukee UWM Digital Commons Theses and Dissertations. Paper 88.

Extended European Search Report for Patent Application No. 14176571.9 dated Feb. 20, 2015.

Bleicher et al, Mechanism of surface modification using machine hammer peening technology, CIRP Annals-Manufacturing Technology, 2012, pp. 375-378, vol. 61.

Office Action for EP Patent Application No. 14176571.9 dated Oct. 6, 2016.

Notice of Allowance for U.S. Appl. No. 14/031,771.

* cited by examiner

APPARATUS, SYSTEM, AND METHOD FOR FORMING METAL PARTS

FIELD

This disclosure relates generally to mechanical systems used to change physical characteristics of metal parts, and more particularly, to apparatuses, systems, and methods for forming metal parts, such as by impacting the metal parts.

BACKGROUND

Metal parts may be fabricated from metal sheet and plate-product forms into, but not limited to, fuselage skins, wing skins, and other structures for aircraft, by using systems including impact peening, ultrasonic peening, and laser peening. Impact peening of metal parts generates vibration and noise which can be high in some applications.

SUMMARY

The subject matter of the present application provides embodiments of methods for forming metal parts that overcome the shortcomings of prior art techniques. In other words, the subject matter of the present application has been developed in response to the present state of the art, and in particular, in response to shortcomings of conventional methods and apparatuses for impacting metal parts.

According to one embodiment, an apparatus for forming a metal workpiece having a first surface includes a trough containing a liquid. The apparatus also includes a support for positioning the metal workpiece in an impact-receiving position. In the impact-receiving position, the first surface is submerged in the liquid. The apparatus includes a driven member for applying multiple impacts to the first surface of the metal workpiece while the metal workpiece is in the impact-receiving position.

In some implementations of the apparatus, the support includes a lower support submerged in the liquid. In such an implementation, the metal workpiece may have a second surface, opposing the first surface, which bears against the lower support when the metal workpiece is in the impact-receiving position.

In one implementation of the apparatus, the lower support is a stand. The lower support may have a curvature that correlates to a desired final shape of the metal workpiece. The support may include multiple upper supports that bear against the first surface of the metal workpiece to oppose the lower support.

According to some implementations, the apparatus may include one or more actuators that dynamically change a force applied by each upper support of the multiple upper supports.

In certain implementations of the apparatus, the support non-movably fixates the metal workpiece relative to the trough. The driven member may be movable relative to a length of the trough as the driven member applies multiple impacts.

In some implementations, the apparatus includes a track extending along the length of the trough. In such implementations, the driven member may be movable along the track.

In certain implementations of the apparatus, the liquid includes at least one of a lubrication additive and a corrosion-prevention additive.

According to one embodiment, a system for forming a metal workpiece includes a trough containing a liquid. The system may include a metal peening machine having a driven member for applying multiple impacts to a surface of the metal workpiece while the surface of the metal workpiece is covered in the liquid. The driven member driven while in contact with the surface of the metal workpiece. The metal peening machine includes a device for driving the driven member. The system may include a controller operably coupled to the device to control impact of the driven member while the driven member is in contact with the surface of the metal workpiece.

In some implementations of the machine, the metal workpiece is fixed relative to the trough and the driven member moves relative to a length of the metal workpiece during operation.

In one implementation of the machine, the device for driving the driven member is movable along the trough as the driven member applies multiple impacts.

According to some implementations of the machine, the device for driving the driven member does not contact the liquid and the driven member contacts the liquid to impact the metal workpiece.

According to one embodiment, a method of forming a metal workpiece includes submerging the metal workpiece in a liquid. The method also includes, with the metal workpiece submerged in the liquid, repeatedly impacting a first surface of the metal workpiece with a driven member.

In some implementations of the method, the liquid includes at least one of a corrosion-prevention additive and a lubrication additive.

In one implementation, the method includes supporting the metal workpiece using a lower support. A second surface of the metal workpiece, opposing the first surface, bears against the lower support.

In certain implementations of the method, supporting the metal workpiece includes supporting the metal workpiece using multiple upper supports that bear against the first surface of the metal workpiece to directly oppose the lower support.

In some implementations, the method includes changing a force applied by each upper support of the plurality of upper supports. In various implementations, the method includes changing a position of each upper support of the plurality of upper supports relative to a trough containing the liquid.

According to certain implementations, the method further includes, with the metal workpiece submerged in the liquid and fixed relative to the liquid, moving the driven member relative to the metal workpiece in a first direction parallel to a width of the metal workpiece and a second direction parallel to a length of the metal workpiece.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter, they are not therefore to be considered to be limiting of its scope. The subject matter will be described and explained with additional specificity and detail through the use of the drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Figure 1:
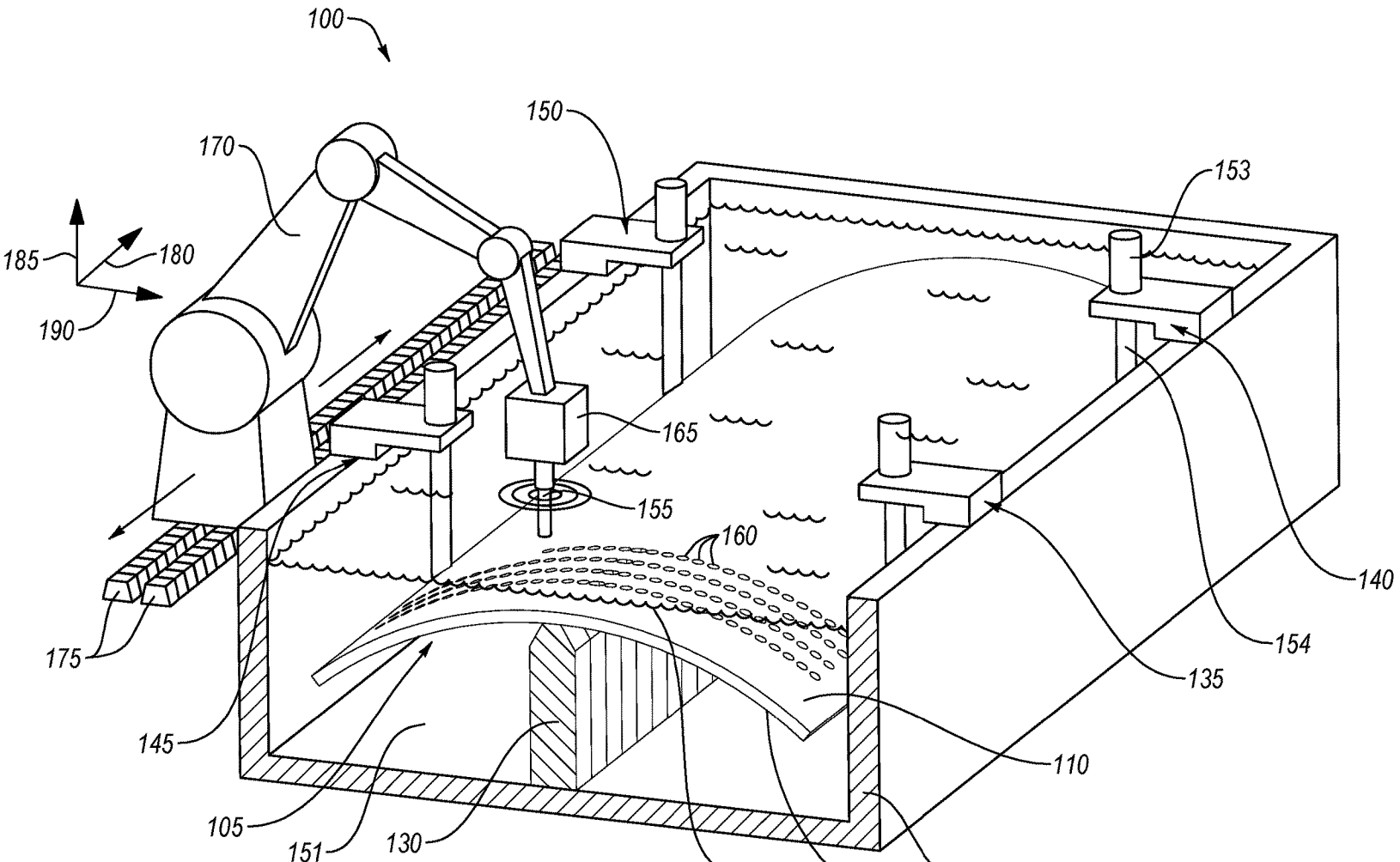
FIG. 1 is a perspective view of one embodiment of an apparatus for forming a metal workpiece.

Referring to FIG. 1, and according to one embodiment, an apparatus 100 for forming a metal workpiece 105 is shown. As illustrated, the metal workpiece 105 includes a first surface 110 on which the apparatus 100 is used to impact the metal workpiece 105, and a second surface 115 opposite the first surface 110. The metal workpiece 105 may be a relatively thin plate with a thickness smaller than a length and a width of the metal workpiece 105. The metal workpiece 105 may be any type of metal workpiece that can be shaped using impact peening. According to certain implementations, the metal workpiece 105 can be made from any of various metals, such as, but not limited to steel, titanium, aluminum, and the like. In some embodiments, the metal workpiece 105 may be shaped into a fuselage skin, a wing skin, or other structure for aircraft.

The apparatus 100 includes a trough 120 that contains a liquid 125 in which the metal workpiece 105 is submerged in an impact-receiving position while impacts are made to the first surface 110 of the metal workpiece 105. As defined, the impact-receiving position is a position in which the metal workpiece 105 is securely submerged in the liquid 125. The trough 120 may be any of various structures suitable for containing the liquid 125. For example, the trough 120 may have an open top with enclosed sides and a bottom, in one implementation. In certain embodiments, a level of the liquid 125 may be monitored to ensure that an amount of the liquid 125 in the trough 120 is at a desired level and/or that a depth of the liquid 125 is at a desired level. Furthermore, the depth of the metal workpiece 105 may also be monitored to ensure that the metal workpiece 105 is submerged in the liquid 125 at a desired depth. Moreover, the trough 120 is sized to facilitate complete submersion of the metal workpiece 105. Accordingly, the trough 120 may be large if, for example, the metal workpiece 105 is used to form a wing skin. In one implementation, the trough 120 may have a length that extends 100 feet, 150 feet, 200 feet, or more.

The liquid 125 may be any liquid suitable for submerging the metal workpiece 105. In one embodiment, the liquid 125 is water. In another embodiment, the liquid 125 includes additives. For example, the liquid 125 may include one or more additives such as lubrication additives, corrosion-prevention additives, and so forth. In a further embodiment, the liquid 125 includes at least one of an oil, a metal, a lubricant, a thickener, and so forth.

The liquid 125 facilitates stiffening of the metal workpiece 105 while the metal workpiece 105 is submerged in the liquid 125 thereby reducing vibrations in the metal workpiece 105. To enhance the vibration-dampening properties of the apparatus 102, the liquid 125 may be a liquid with a density greater than water. Submerging the metal workpiece 105 in the liquid 125 increases the efficiency of impacts to the metal workpiece 105 by providing inertial stiffening, and the liquid 125 may reduce noise generation. For example, in certain embodiments, by impacting the metal workpiece 105 while the metal workpiece 105 is submerged in the liquid 125 noise generated by the impacts may be reduced by approximately 10 dB, 20 dB, or 30 dB compared to a metal workpiece 105 that is not submerged.

The metal workpiece 105 may be submerged in the liquid 125 at any suitable depth. For example, a minimum depth that the metal workpiece 105 may be submerged in the liquid 125 may be less than or greater than 1, 2, or 3 inches. In some embodiments, the metal workpiece 105 may be submerged in the liquid 125 less than 10, 14, 16, or 20 inches. In one embodiment, to avoid water damage to electronic components or other components of the apparatus 100 unsuitable for contact with water, a maximum depth may be limited by a length of a driven member that impacts the metal workpiece 105.

One or more supports may be used to securely position the metal workpiece 105 in the impact-receiving position submerged in the liquid 125, as illustrated. In one embodiment, the supports include a lower support 130 and upper supports 135, 140, 145, 150. Generally, the lower support 130 and upper supports 135, 140, 145, 150 cooperate to releasably fixate the metal workpiece 105 in a non-movable position, submerged in the liquid 125, relative to the trough 120.

Figure 3:
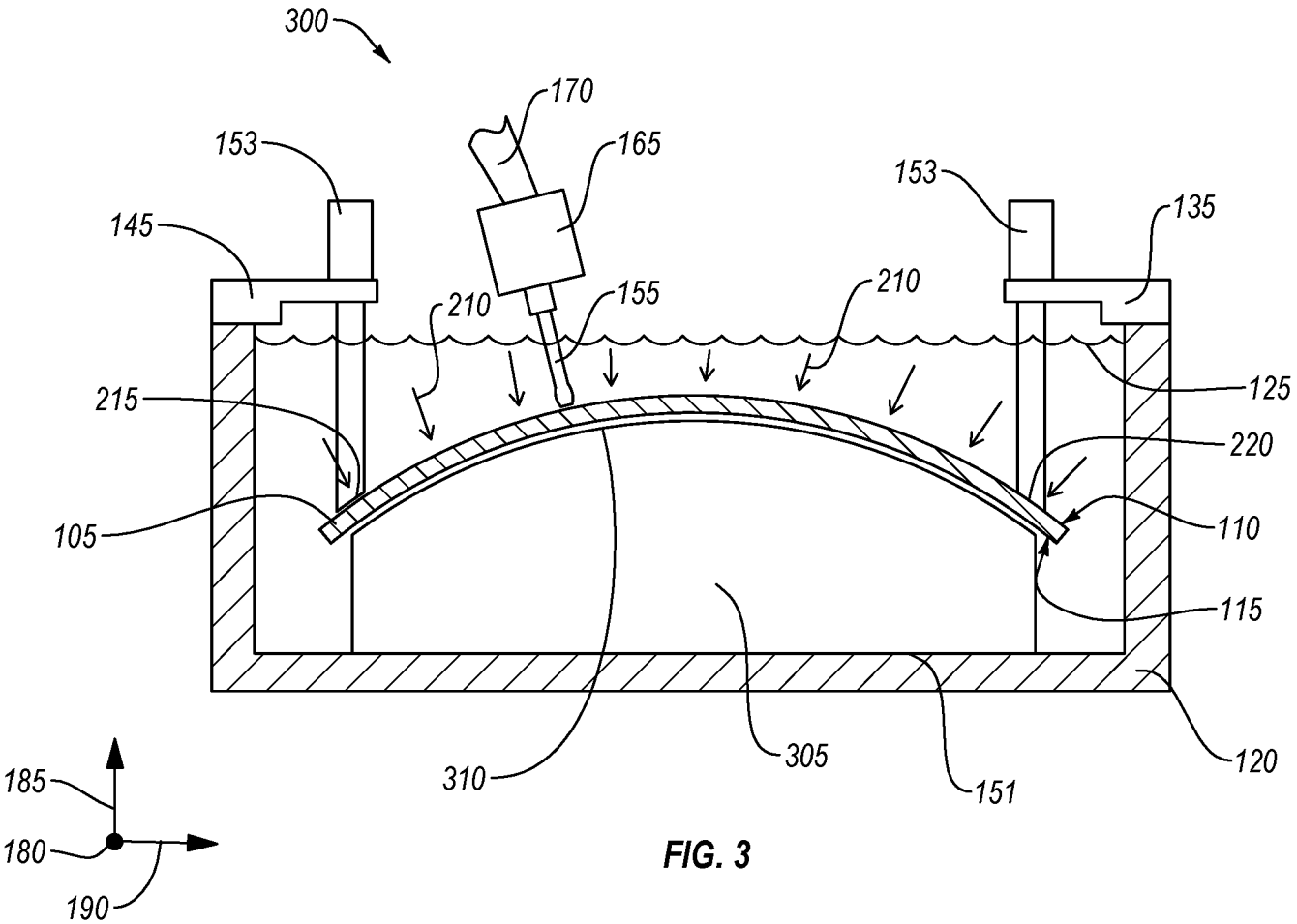
FIG. 3 is a cross-sectional front elevational view of an apparatus for forming a metal workpiece according to another embodiment.

The lower support 130 extends upwardly from a bottom surface 151 of the trough 120, such that when the liquid 125 is contained within the trough 120, the lower support 130 is submerged in the liquid 125 below the metal workpiece 105. Moreover, the second surface 115 of the metal workpiece 105 bears against the lower support 130 when the metal workpiece 105 is in the impact-receiving position. In other words, the lower support 130 supports the second surface 115 of the metal workpiece 105. As may be appreciated, while only one lower support 130 is illustrated, more than one lower support 130 may be used. In one embodiment, the lower support 130 may be a stand positioned relative to the trough 120 to contact a predetermined location on the second surface 115 of the metal workpiece 105. For example, the lower support 130 may be positioned to contact a central position of the metal workpiece 105 to define a point of inflection of the metal workpiece 105, or an off-center position of the metal workpiece 105. In one embodiment, the lower support 130 may be positioned to contact the lower surface 115 of the metal workpiece 105 at a location approximately one-third of a width across the metal workpiece 105. In certain embodiments, a horizontal position of the lower support 130 may vary along the length of the trough 120 to support a metal workpiece 105 with a width that varies along its length. Moreover, in some embodiments, the lower support 130 may include any number of lower supports, and the number of lower supports may vary along the length of the trough 120 to support a metal workpiece 105 with a width that varies along its length. As may be appreciated, the width of the metal workpiece 105 may be the shortest side of the metal workpiece 105, while the length of the metal workpiece 105 may be the longest side of the metal workpiece 105. In one embodiment, as illustrated in FIG. 3, the lower support 130 may have a curvature that correlates to a shape to be formed (e.g., formed shape) of the metal workpiece 105.

In various embodiments, the lower support 130 is dynamically movable during operation of the apparatus 100. For example, one or more actuators (not shown) may change a vertical and/or horizontal position of the lower support 130 to adjust a vertical and/or horizontal position of the lower support 130 relative to the trough 120 and the metal workpiece 105 supported in the trough 120. Changing the vertical position of the lower support 130 can change a force applied by the lower support 130 to the metal workpiece 105 (e.g., applied stress, preloading, etc.).

The upper supports 135, 140, 145, 150 extend into the liquid 125 to contact and contain the metal workpiece 105. Generally, the upper supports 135, 140, 145, 150 bear against the first surface 110 of the metal workpiece 105 when the metal workpiece 105 is in the impact-receiving position to directly oppose the lower support 130 such that the lower support 130 and the upper supports 135, 140, 145, 150 collectively clamp the metal workpiece 105 therebetween. As may be appreciated, while only four upper supports 135, 140, 145, 150 are illustrated, any number of upper supports may be used.

In various embodiments, the upper supports 135, 140, 145, 150 may be dynamically movable during operation of the apparatus 100. For example, in one embodiment, one or more actuators 153 may change a vertical and/or horizontal position of an movable portion 154 of each of the upper supports 135, 140, 145, 150 to adjust a vertical position of the upper supports 135, 140, 145, 150 relative to the trough 120 for changing a force applied by the upper supports 135, 140, 145, 150 to the metal workpiece 105 (e.g., applied stress, preloading, etc.). For example, as the metal workpiece 105 is deformably shaped a force applied to the metal workpiece 105 by the upper supports 135, 140, 145, 150 may need to be adjusted. As may be appreciated, the liquid 125 may contact at least a portion of the upper supports 135, 140, 145, 150. For example, at least a portion of the upper supports 135, 140, 145, 150 may be submerged in the liquid 125.

The apparatus 100 includes a driven member 155 (e.g., impactor) for applying multiple impacts 160 to the first surface 110 of the metal workpiece 105 while the metal workpiece 105 is in the impact-receiving position submerged (e.g., covered) in the liquid 125. An end (e.g., impact surface) of the driven member 155 is driven while submerged in the liquid 125 and in contact with the first surface 110 of the metal workpiece 105. As may be appreciated, the multiple impacts 160 are merely representative of the impacts to the metal workpiece 105 caused by the driven member 155. In certain embodiments, the driven member 155 may impact one location many times, and the driven member 155 may impact any position on the first surface 110 of the metal workpiece 105.

Generally, the driven member 155 has a hardness greater than a hardness of the metal workpiece 105. In some embodiments, the driven member 155 may be made from a single material, while in other embodiments, the driven member 155 may be made from a combination of materials. In various embodiments, the driven member 155 may be formed from materials that are conducive to contact with the liquid 125. For example, the driven member 155 may be formed with, or coated by, a corrosion resistant material. As described in U.S. Pat. No. 8,997,545, which is incorporated herein by reference in its entirety, the multiple impacts 160 from the driven member 155 change physical characteristics of the metal workpiece 105 until a final useful component or part, such as for use on an aircraft, is formed.

The apparatus 100 includes a device 165 (e.g., end effector) coupled to the driven member 155 and operable to drive the driven member 155 into contact with the first surface 110 of the metal workpiece 105. During operation, in certain embodiments, the driven member 155 may move (e.g., slide drag, etc.) along the first surface 110 of the metal workpiece 105 to a position for impacting the metal workpiece 105. Upon reaching the position for impacting the metal workpiece 105, the device 165 may drive the driven member 155 to impact the metal workpiece 105 using any suitable manner. For example, in one embodiment, a motor in the device 165 may rotate to drive the driven member 155 to impact the metal workpiece 105. In certain embodiments, the device 165 does not contact the liquid 125.

A mechanical assembly 170 (e.g., robot) primary function is to move the device 165 and the driven member 155 across the first surface 110 of the metal workpiece 105. As may be appreciated, the mechanical assembly 170 may move the device 165 and the driven member 155 across a width and/or a length of the first surface 110 of the metal workpiece 105. Moreover, the mechanical assembly 170 may also rotate relative to the first surface 110 of the metal workpiece 105. A secondary purpose of the mechanical assembly 170 is to mechanically couple the device 165 to a track 175 that extends in a first direction parallel to a first axis 180 along the length of the trough 120 and along the length of the metal workpiece 105. The mechanical assembly 170 may facilitate positioning the device 165 and the driven member 155 at a depth relative to the trough 120 in a second direction parallel to a second axis 185 along the width of the trough 120 in a third direction parallel to a third axis 190 for impacting various depth positions along the width of the metal workpiece 105. As may be appreciated, the mechanical assembly 170 may move in a direction of any combination of the first axis 180, the second axis 185, and the third axis 190. Movement of the mechanical assembly 170 along the track 175 facilitates positioning the device 165 and the driven member 155 along the length of the trough 120 in the first direction parallel to the first axis 180 for impacting the metal workpiece 105 along the length of the metal workpiece 105. Accordingly, the driven member 155 is movable via the track 175 along the trough 120 as the driven member 155 applies multiple impacts 160.

Figure 4:
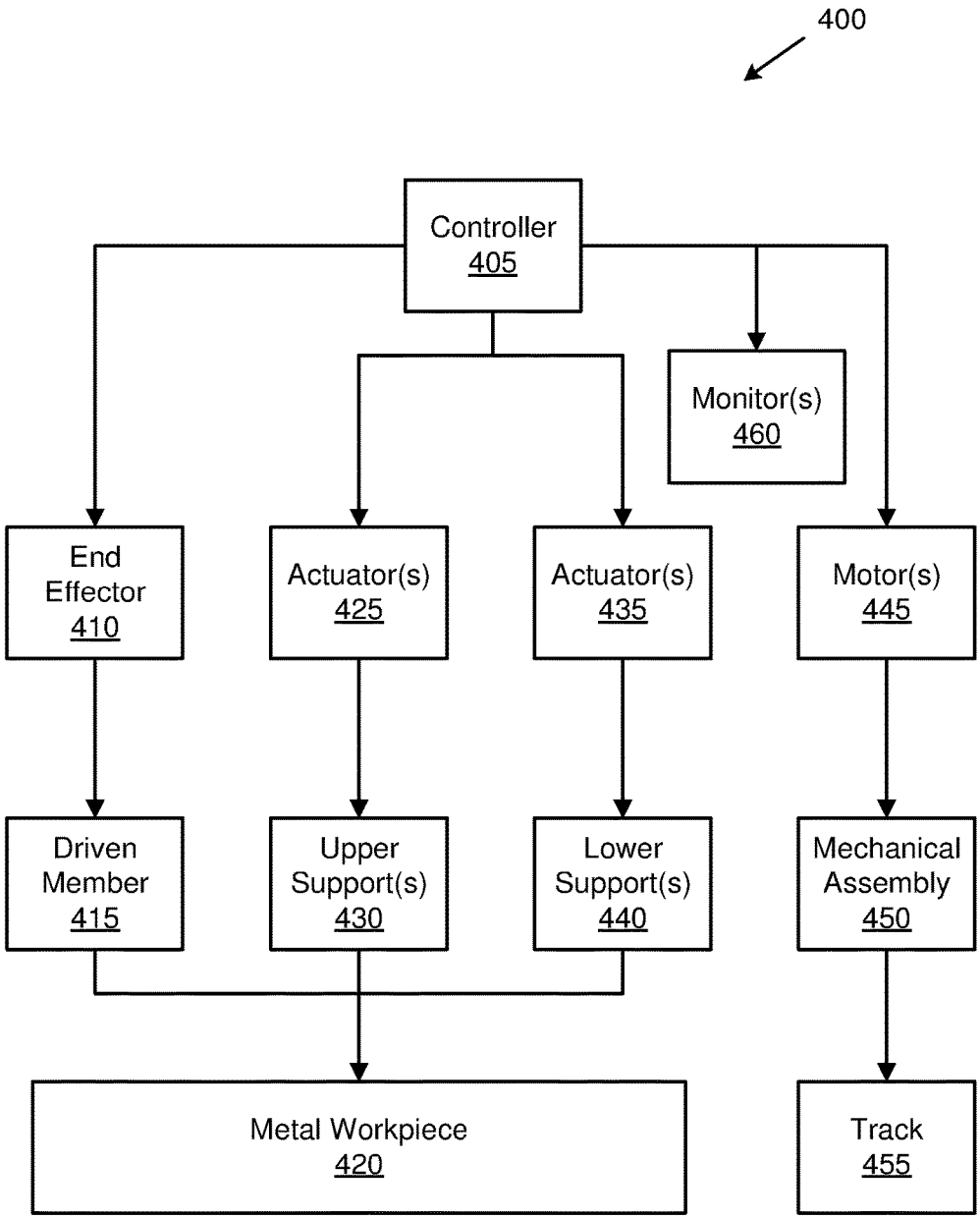
FIG. 4 is a schematic block diagram of one embodiment of a system for controlling the formation of a metal workpiece.

As explained in detail in FIG. 4, a controller may be coupled to the device 165 to control impact of the driven member 155 while a portion of the driven member 155 is submerged in the liquid 125 and is in contact with the first surface 110 of the metal workpiece 105. The controller may be coupled to the mechanical assembly 170 for controlling positions of the device 165 and the driven member 155, and for controlling a position of the mechanical assembly 170 along the track 175. Furthermore, the controller may be coupled to actuators for controlling positions of the lower support 130 and/or the upper supports 135, 140, 145, 150.

Figure 2:
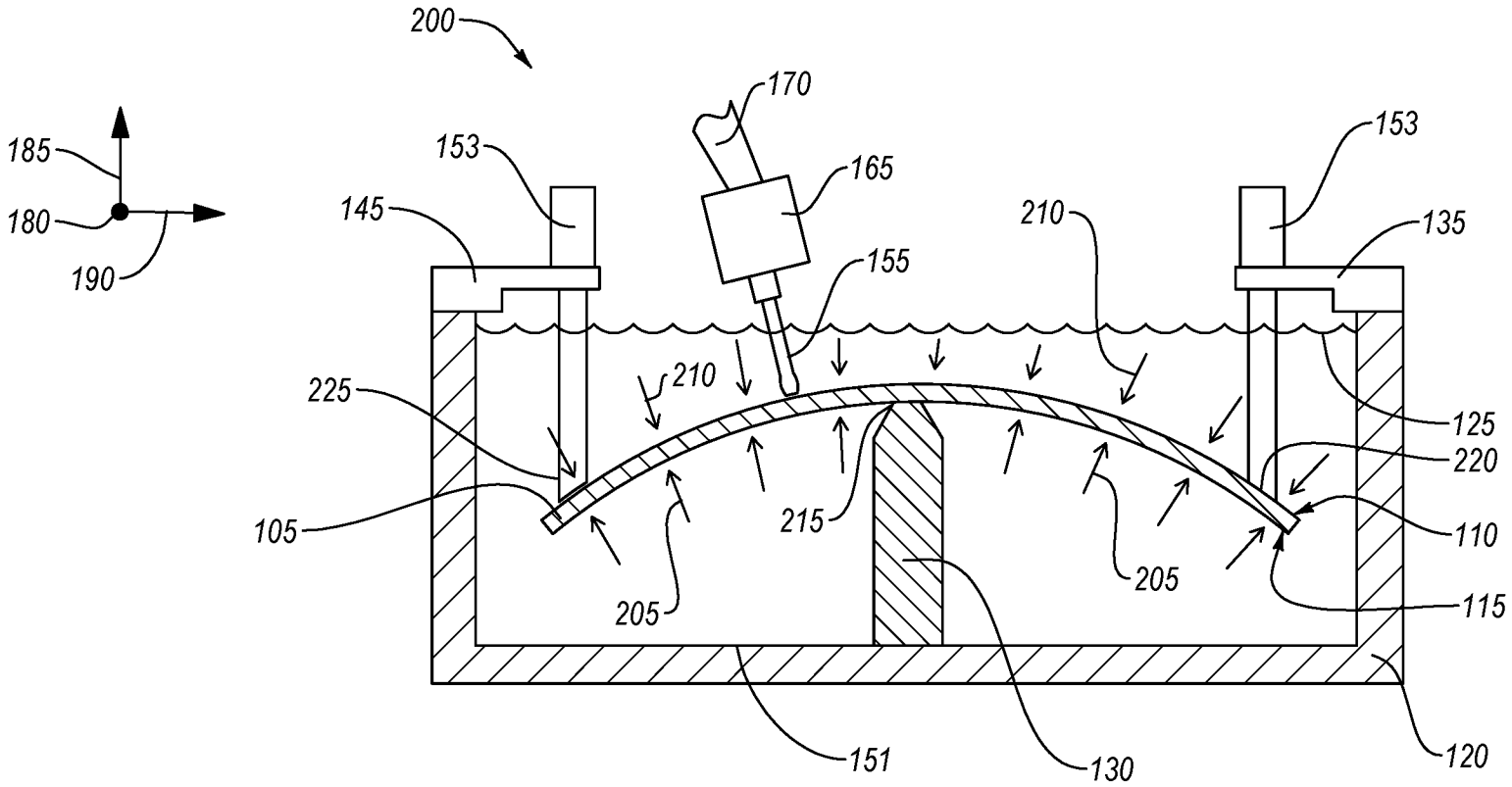
FIG. 2 is a cross-sectional front elevational view of the apparatus of FIG. 1, according to one embodiment.

Referring to FIG. 2, a cross-sectional-view 200 of the apparatus 100 of FIG. 1 is illustrated showing supports for releasably securing the metal workpiece 105 in the trough 120 according to one embodiment. As illustrated, because the metal workpiece 105 is submerged in the liquid 125, the liquid 125 applies an inertial constraint 205 to the second surface 115 of the metal workpiece 105, and an inertial constraint 210 to the first surface 110 of the metal workpiece. That is, the presence of water adjacent to the metal workpiece 105 produces a counterforce (proportional to its inertia) whenever the metal workpiece 105 experiences a motion inducing force, such as when impacts may be occurring. Accordingly, by submerging the metal workpiece 105 in the liquid 125, the liquid 125 may increase impact efficiency of impacts to the metal workpiece 105 by providing inertial stiffening, and the liquid 125 may reduce noise generation caused by such impacts.

A first end 215 of the lower support 130 contacts the second surface 115 of the metal workpiece 105 such that the second surface 115 of the metal workpiece 105 bears against the lower support 130. In certain embodiments, a position of the first end 215 may be adjusted to change the position of the metal workpiece 105 relative to the trough 120 in the second direction parallel to the second axis 185. In some embodiments, a force imparted to the metal workpiece 105 by the first end 215 is adjusted to change a force applied by the lower support 130 to the second surface 115 of the metal workpiece 105 in the second direction parallel to the second axis 185.

Ends 220, 225 of the upper supports 135, 145 contact the first surface 110 of the metal workpiece 105 such that the ends 220, 225 bear against the first surface 110 of the metal workpiece 105. In certain embodiments, a position of the ends 220, 225 may be adjusted to change the position of the metal workpiece 105 relative to the trough 120 in the second direction parallel to the second axis 185. For example, the position of the ends 220, 225 may extend downward toward the bottom of the trough 120 to apply stress (e.g., preloading) on the metal workpiece 105 to aid in shaping the metal workpiece 105. As may be appreciated, the liquid 125 may contact the ends 220, 225 of the upper supports 135, 145 and/or other portions of the upper supports 135, 145. For example, the ends 220, 225 of the upper supports 135, 145 may be submerged in the liquid 125. In some embodiments, a force applied by the ends 220, 225 may be adjusted to change a force applied by the upper supports 135, 145 to the first surface 110 of the metal workpiece 105 in the second direction parallel to the second axis 185.

Referring to FIG. 3, a cross-sectional-view 300 of the apparatus 100 of FIG. 1 is illustrated showing supports for positioning the metal workpiece 105 according to another embodiment. As illustrated, a lower support 305 is shaped to have a curvature 310 that correlates to a desired final shape of the metal workpiece 105. In one embodiment, the curvature 310 matches or substantially matches a desired final shape of the metal workpiece 105. In some embodiments, the lower support 305 may have any suitable shape that supports a desired final shape of the metal workpiece 105. For example, the lower support 305 may have some intermediate shape between an initial shape of the metal workpiece 105 and the desired final shape of the metal workpiece 105. A portion of the lower support 305 contacts the second surface 115 of the metal workpiece 105 such that the second surface 115 of the metal workpiece 105 bears against the lower support 305. As may be appreciated, in certain embodiments, impacts by the driven member 155 to the first surface 110 of the metal workpiece 105 opposite the lower support 305 may have greater efficiency because the lower support 305 may block some deflection of the metal workpiece 105. Additionally, the lower support 305 and the liquid 125 may reduce generation of noise from the impacts.

Referring to FIG. 4, a schematic block diagram of one embodiment of a system 400 for controlling formation of a metal workpiece, such as the metal workpiece 105, is illustrated. The system 400 includes a controller 405 that may be used to control various portions of the apparatus 100. In certain embodiments, portions of the system 400 may be part of the apparatus 100. The controller 405 may include any suitable hardware and/or software to facilitate control of various components of the system 400.

The controller 405 is operably coupled to an end effector 410 (e.g., device 165) to control impact of a driven member 415 (e.g., driven member 155) as a portion of the driven member 415 is submerged in a liquid (e.g., liquid 125) and is in contact with a surface (e.g., first surface 110) of a metal workpiece 420 (e.g., metal workpiece 105). In certain embodiments, the controller 405 may control when the end effector 410 drives the driven member 415 to impact the metal workpiece 420. Furthermore, in certain embodiments, the controller 405 may control a position of the driven member 415 to position the driven member 415 for impacting the metal workpiece 420. In one embodiment, the controller 405 may be programmed with a desired shape of the metal workpiece 420 and may control impacts of the driven member 415 to produce the desired shape of the metal workpiece 420.

Additionally, the controller 405 is operably coupled to one or more actuators 425 for dynamically controlling positions of and/or forces applied by one or more upper supports 430 (e.g., upper supports 135, 140, 145, 150) used to position the metal workpiece 420, as explained in FIG. 1. Furthermore, the controller 405 is operably coupled to one or more actuators 435 (e.g., actuators 153) for dynamically controlling positions of and/or forces applied by one or more lower supports 440 (e.g., lower support 130) used to position the metal workpiece 420, as explained in FIG. 1. The actuators 425, 435 may be any suitable type of actuators for positioning the supports 430, 440.

Moreover, the controller 405 is operably coupled to one or more motors 445 for dynamically controlling a position of a mechanical assembly 450 (e.g., mechanical assembly 170) along a track 455 (e.g., track 175). The one or more motors 445 may be any suitable motors for moving the mechanical assembly 450 along the track 455. In some embodiments, the controller 405 is operably coupled to one or more monitors 460 used to monitor a level of the liquid 125 in the trough 120 to ensure that the metal workpiece 105 is submerged to a desired depth. The controller 405 may also, in certain embodiments, be used to control the position of the metal workpiece 420 to be submerged to a desired depth in the liquid 125.

Figure 5:
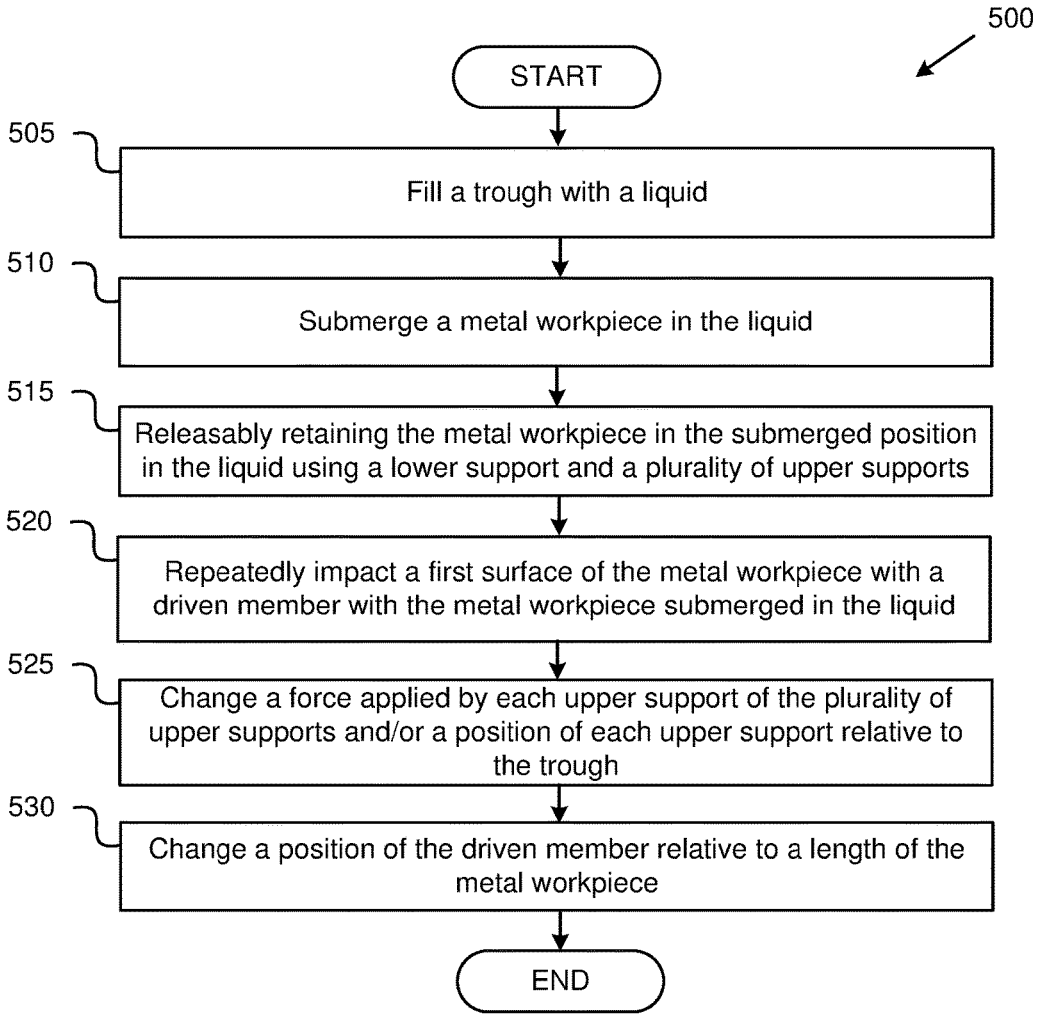
FIG. 5 is a schematic flow diagram of one embodiment of a method of forming a metal workpiece.

Referring to FIG. 5, a method 500 of forming a metal workpiece, such as the metal workpiece 105, is shown. As may be appreciated, while the method 500 is described in one order, portions of the method 500 may be performed in any suitable order. The method 500 includes filling a trough 120 with a liquid 125 at 505. In one embodiment, the liquid 125 includes at least one of a corrosion preventative additive and a lubrication additive. The method 500 includes submerging a metal workpiece 105 in the liquid 125 at 510 such that the first surface 110 is covered by, or submerged under, the liquid 125.

The method 500 includes releasably retaining the metal workpiece 105 in the submerged position in the liquid 125 using a lower support 130 and multiple upper supports 135, 140, 145, 150 at 515. In one embodiment, a second surface 115 of the metal workpiece 105 bears against the lower support 130. In another embodiment, the upper supports 135, 140, 145, 150 bear against a first surface 110 of the metal workpiece 105. The method 500 includes repeatedly impacting the first surface 110 of the metal workpiece 105 with a driven member 155 and with the metal workpiece 105 submerged in the liquid 125 at 520. The method 500 includes changing a force applied by each upper support 135, 140, 145, 150 and/or a position of each upper support 135, 140, 145, 150 relative to the trough 120 at 525. The method 500 includes changing a position of the driven member 155 relative to a length and/or width of the metal workpiece 105 at 530.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. An apparatus for forming a metal workpiece having a first surface, the apparatus comprising:

a trough containing a liquid;

a support for positioning the metal workpiece in an impact-receiving position, wherein in the impact-receiving position, the first surface is submerged in the liquid;

a driven member for applying multiple impacts to the first surface of the metal workpiece by the driven member contacting the first surface of the metal workpiece while the metal workpiece is in the impact-receiving position, wherein a hardness of the driven member is greater than a hardness of the metal workpiece;

a track extending along a length of the trough; and a robot having the driven member attached thereto, wherein the robot is movable along the track to enable the driven member to move relative to the length of the trough as the driven member applies multiple impacts to the metal workpiece.

2. The apparatus of claim 1, wherein:

the support comprises a lower support submerged in the liquid; and the metal workpiece has a second surface, opposing the first surface, which bears against the lower support when the metal workpiece is in the impact-receiving position.

3. The apparatus of claim 2, wherein the lower support is a stand.

4. The apparatus of claim 2, wherein the lower support has a curvature that correlates to a desired final shape of the metal workpiece.

5. The apparatus of claim 2, wherein the support further comprises a plurality of upper supports that bear against the first surface of the metal workpiece to oppose the lower support.

6. The apparatus of claim 5, further comprising one or more actuators that dynamically change a force applied by each upper support of the plurality of upper supports.

7. The apparatus of claim 1, wherein the support non-movably fixates the metal workpiece relative to the trough.

8. The apparatus of claim 1, wherein the liquid comprises at least one of a lubrication additive and a corrosion-prevention additive.

9. A system for forming a metal workpiece, the system comprising:

a trough containing a liquid;

a track extending along a length of the trough;

a metal peening machine comprising:

a driven member for applying multiple impacts to a surface of the metal workpiece by the driven member contacting the first surface of the metal workpiece while the surface of the metal workpiece is covered in the liquid, the driven member driven while in contact with the surface of the metal workpiece, wherein a hardness of the driven member is greater than a hardness of the metal workpiece; and a device for driving the driven member, wherein the metal peening machine is movable along the track to enable the driven member to move relative to the length of the trough during operation; and a controller operably coupled to the device to control impacts of the driven member while the driven member is in contact with the surface of the metal workpiece.

10. The system of claim 9, wherein:

the metal workpiece is fixed relative to the trough; and the driven member moves relative to the length of the metal workpiece during operation.

11. The system of claim 9, wherein the device for driving the driven member is movable along the trough as the driven member applies multiple impacts.

12. The system of claim 9, wherein:

the device for driving the driven member does not contact the liquid; and the driven member contacts the liquid to impact the metal workpiece.

13. The system of claim 9, wherein the controller is operably coupled to a motor to control a position of the metal peening machine along the track.

14. The system of claim 9, wherein the controller is operably coupled to a monitor to monitor a level of the liquid in the trough.

15. The system of claim 9, wherein the controller is configured to control a depth of the metal workpiece in the trough.

16. The system of claim 9, wherein the controller is programmed with a shape for the metal workpiece.

17. The system of claim 16, wherein the controller controls the driven member to produce the shape.

18. The system of claim 9, further comprising a support for positioning the metal workpiece.

19. The system of claim 18, further comprising an actuator controlled by the controller.

20. The system of claim 19, wherein the controller controls the actuator to control a force applied by the support.

* * * * *